US010950216B2

(12) United States Patent
Tani

(10) Patent No.: US 10,950,216 B2
(45) Date of Patent: Mar. 16, 2021

(54) ACTIVE NOISE CONTROL DEVICE, VEHICLE, AND ACTIVE NOISE CONTROL METHOD

(71) Applicant: PANASONIC INTELLECTUAL PROPERTY MANAGEMENT CO., LTD., Osaka (JP)

(72) Inventor: Mitsuhiro Tani, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/594,729

(22) Filed: Oct. 7, 2019

(65) Prior Publication Data

US 2020/0118538 A1 Apr. 16, 2020

(30) Foreign Application Priority Data

Oct. 15, 2018 (JP) ..... JP2018-194137

(51) Int. Cl.
*G10K 11/178* (2006.01)

(52) U.S. Cl.
CPC .. *G10K 11/17854* (2018.01); *G10K 11/17881* (2018.01); *G10K 2210/1282* (2013.01); *G10K 2210/3026* (2013.01); *G10K 2210/3027* (2013.01); *G10K 2210/3028* (2013.01); *G10K 2210/3044* (2013.01); *G10K 2210/3056* (2013.01)

(58) Field of Classification Search
CPC ..... G10K 2210/1282; G10K 11/17854; G10K 2210/128; G10K 11/17881; G10K 2210/12; G10K 2210/3039; G10K 2210/3226; G10K 11/17823; G10K 11/17825; G10K 2210/3036; H04R 2410/05
USPC ..... 381/71.1, 71.2, 71.4, 71.8, 71.11
See application file for complete search history.

(56) References Cited

U.S. PATENT DOCUMENTS

2011/0243345 A1* 10/2011 Carreras ..... G10L 21/0208 381/71.6
2013/0177162 A1* 7/2013 Lim ..... G10L 21/0208 381/66

(Continued)

FOREIGN PATENT DOCUMENTS

JP 08-129388 5/1996
WO 2014/006846 1/2014

*Primary Examiner* — George C Monikang
(74) *Attorney, Agent, or Firm* — Greenblum & Bernstein, P.L.C.

(57) ABSTRACT

An active noise control device includes: a reference signal source that outputs a reference signal having a correlation with noise; a reference signal input unit configured to receive the reference signal output from the reference signal source; a compressor that compresses the reference signal and outputs a compressed signal of the reference signal when an amplitude of the reference signal received by the reference signal input unit is greater than or equal to a threshold; and an adaptive filter unit configured to generate a canceling signal having a phase opposite to a phase of the compressed signal by multiplying the compressed signal using an adaptive filter having a coefficient that is updated successively. The coefficient of the adaptive filter is updated using a step size parameter for determining an amount of updating the coefficient of the adaptive filter based on a change in the amplitude of the reference signal.

17 Claims, 8 Drawing Sheets

(56) References Cited

U.S. PATENT DOCUMENTS

| | | | | |
|---|---|---|---|---|
| 2015/0063581 | A1 | 3/2015 | Tani et al. | |
| 2016/0086593 | A1* | 3/2016 | Kim | G10K 11/17857 381/71.4 |

* cited by examiner

ACTIVE NOISE CONTROL DEVICE, VEHICLE, AND ACTIVE NOISE CONTROL METHOD

CROSS REFERENCE TO RELATED APPLICATION

The present application claims the benefit of Japanese Patent Application No. 2018-194137 filed Oct. 15, 2018. The entire disclosure of the above-identified application, including the specification, drawings and claims is incorporated herein by reference in its entirety.

FIELD

The present disclosure relates to an active noise control device that actively reduces noise by producing interference between the noise and a canceling sound, a vehicle including the active noise control device, and an active noise control method.

BACKGROUND

Conventionally, an active noise control device has been known that actively reduces noise by emitting a canceling sound for canceling the noise from a canceling sound source using a reference signal having a correlation with the noise and an error signal based on a residual sound resulting from interference between the noise in a predetermined space and the canceling sound (for example, see Patent Literature (PTL) 1). The active noise control device generates a canceling signal for emitting the canceling sound using an adaptive filter in such a manner that the sum of squares of the error signal is minimized.

CITATION LIST

Patent Literature

[PTL 1] International publication No. 2014/006846

SUMMARY

Technical Problem

However, the active noise control device disclosed in PTL 1 can be improved upon. In view of this, the present disclosure provides an active noise control device, a vehicle, and an active noise control method capable of improving upon the above related art.

Solution to Problem

An active noise control device according to one aspect of the present disclosure includes: a reference signal source that outputs a reference signal having a correlation with noise; a reference signal input unit configured to receive the reference signal output from the reference signal source; a compressor that compresses the reference signal and outputs a compressed signal of the reference signal when an amplitude of the reference signal received by the reference signal input unit is greater than or equal to a threshold; and an adaptive filter unit configured to generate a canceling signal having a phase opposite to a phase of the compressed signal by multiplying the compressed signal using an adaptive filter having a coefficient that is updated successively. The coefficient of the adaptive filter is updated using a step size parameter for determining an amount of updating the coefficient of the adaptive filter based on a change in the amplitude of the reference signal.

Advantageous Effects

The active noise control device, etc. according to one aspect of the present disclosure is capable of improving upon the above related art.

BRIEF DESCRIPTION OF DRAWINGS

These and other objects, advantages and features of the present disclosure will become apparent from the following description thereof taken in conjunction with the accompanying drawings that illustrate a specific embodiment of the present disclosure.

DESCRIPTION OF EMBODIMENTS

Hereinafter, embodiments are specifically described with reference to the drawings. Note that the embodiments described below each show a general or specific example. Numerical values, shapes, materials, structural components, arrangement and connection configuration of the structural components, steps, and the order of the steps shown in the following embodiment are mere examples, and are not intended to limit the present disclosure. Moreover, among the structural components in the following embodiments, structural components not recited in any of the independent claims defining the broadest concepts of the present disclosure are described as optional structural components.

Moreover, the respective figures are schematic illustrations and are not necessarily precise illustrations. Note that, in the figures, substantially identical structural components share like reference signs, and overlapping explanations may be omitted or simplified.

Embodiment 1

Configuration of Car Including Active Noise Control Device

Figure 1:
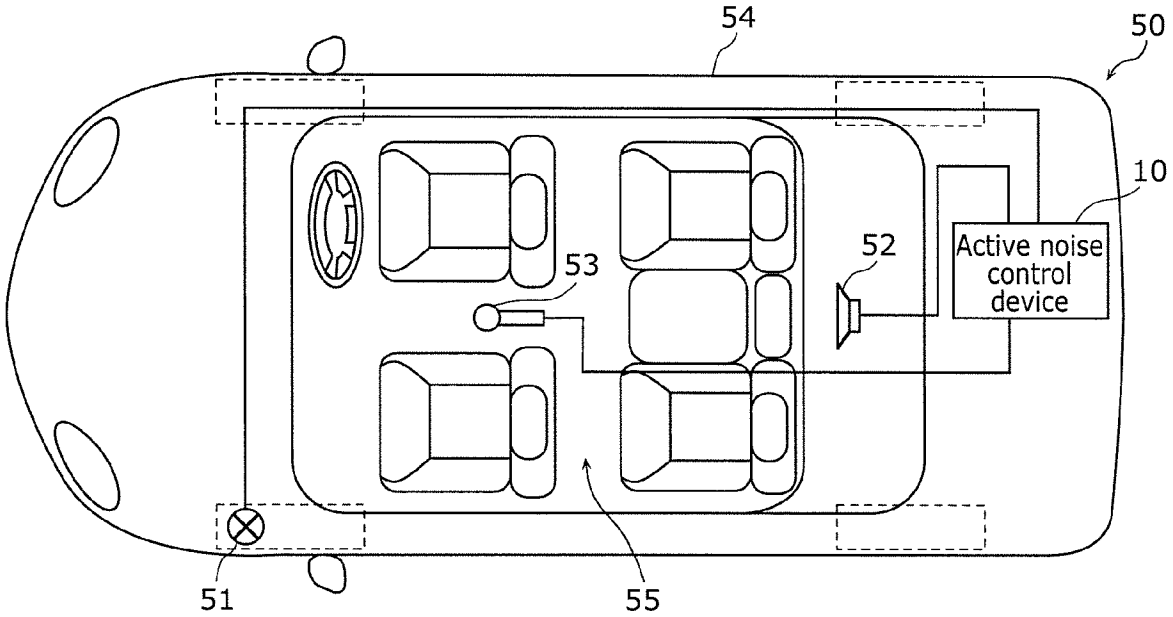
FIG. 1 is a schematic top view of a car including an active noise control device according to Embodiment 1.

Embodiment 1 describes an active noise control device provided in a car. FIG. 1 is a schematic top view of a car including an active noise control device according to Embodiment 1.

Car 50 is an example of a vehicle, and includes active noise control device 10 according to Embodiment 1, reference signal source 51, canceling sound source 52, error signal source 53, and car body 54. Specifically, car 50 is an automobile, but is not particularly limited to this.

Reference signal source 51 is a transducer that outputs a reference signal having a correlation with noise in space 55 of the passenger compartment of car 50. In Embodiment 1, reference signal source 51 is an acceleration sensor, and is placed outside of space 55. Specifically, reference signal source 51 is mounted on a sub frame near a left front wheel (or a wheel well of the left front wheel). Note that the position of mounting reference signal source 51 is not particularly limited to this. Furthermore, reference signal source 51 may be a microphone.

Canceling sound source 52 emits a canceling sound to space 55 using a canceling signal. In Embodiment 1, although canceling sound source 52 is a loudspeaker, a canceling sound may be emitted by exciting a component structure (for example, sun roof etc.) of car 50 using a drive mechanism, such as an actuator. Furthermore, in active noise control device 10, a plurality of canceling sound sources 52 may be used, and the position of mounting canceling sound source 52 is not particularly limited.

Error signal source 53 detects a residual sound resulting from interference between the noise and the canceling sound in space 55, and outputs an error signal based on the residual sound. Error signal source 53 is a transducer such as a microphone, and may be desirably placed in space 55, such as on a headliner. Note that car 50 may include a plurality of error signal sources 53.

Car body 54 is a structure formed by a chassis, a body, etc. of car 50. Car body 54 forms space 55 (space in the passenger compartment) in which canceling sound source 52 and error signal source 53 are placed.

Configuration of Active Noise Control Device

Figure 2:
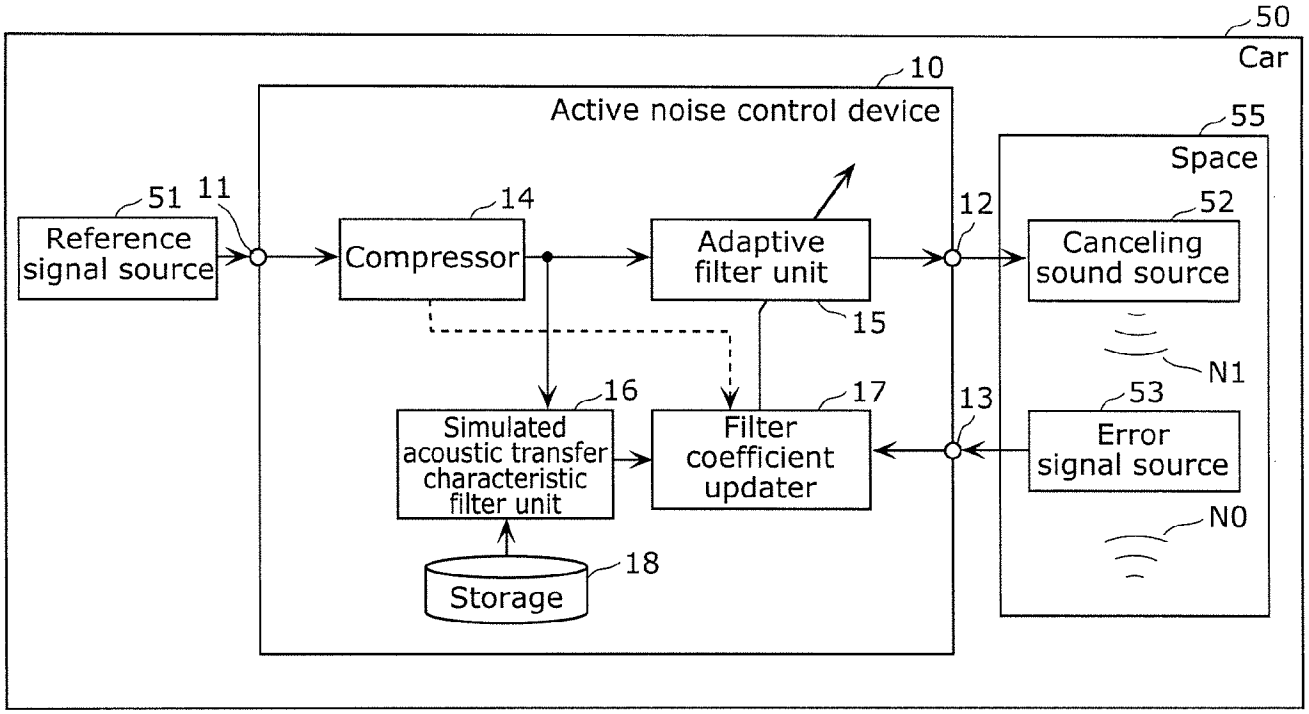
FIG. 2 is a block diagram illustrating a functional configuration of the active noise control device according to Embodiment 1.

Next, the configuration of active noise control device 10 will be described. FIG. 2 is a block diagram illustrating a functional configuration of active noise control device 10.

As illustrated in FIG. 2, active noise control device 10 includes: reference signal input terminal 11, canceling signal output terminal 12, error signal input terminal 13, compressor 14, adaptive filter unit 15, simulated acoustic transfer characteristic filter unit 16, filter coefficient updater 17, and storage 18. Compressor 14, adaptive filter unit 15, simulated acoustic transfer characteristic filter unit 16, and filter coefficient updater 17 may be implemented by, for example, executing software by a processor or a microcomputer such as a digital signal processor (DSP). Compressor 14, adaptive filter unit 15, simulated acoustic transfer characteristic filter unit 16, and filter coefficient updater 17 each may be implemented as hardware, such as a circuit. Moreover, a part of compressor 14, adaptive filter unit 15, simulated acoustic transfer characteristic filter unit 16, and filter coefficient updater 17 may be implemented as software, and the other parts of those structural components may be implemented as hardware.

Basic Operation

Figure 3:
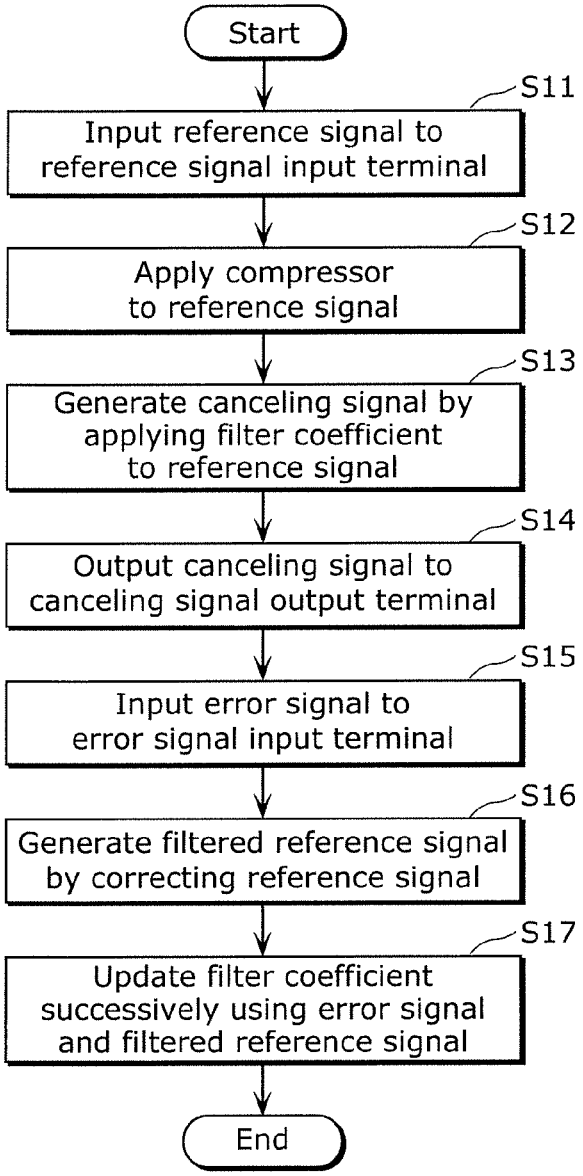
FIG. 3 is a flow chart of a basic operation of the active noise control device according to Embodiment 1.

As described above, active noise control device 10 performs a noise reduction operation. First, a basic operation of active noise control device 10 will be described with reference to FIG. 3 as well as FIG. 2. FIG. 3 is a flow chart of the basic operation of active noise control device 10.

First, the reference signal having a correlation with noise N0 is input from reference signal source 51 to reference signal input terminal 11 (S11). Reference signal input terminal 11 is an exemplary reference signal input unit, and is particularly a terminal made of metal, etc.

Figure 4:
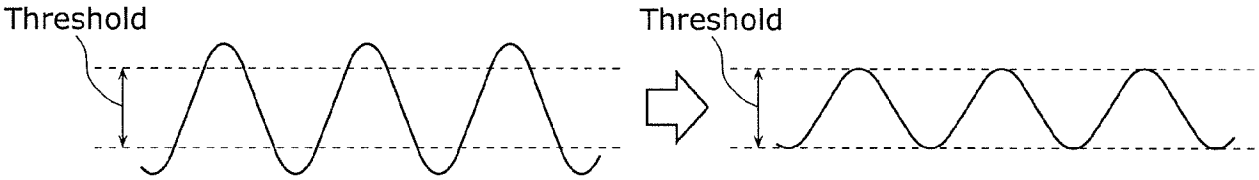
FIG. 4 illustrates signal processing performed by a compressor when the amplitude of a reference signal is greater than or equal to a threshold.

The reference signal input to reference signal input terminal 11 is output to adaptive filter unit 15 and simulated acoustic transfer characteristic filter unit 16 via compressor 14. In other words, compressor 14 is applied to the reference signal (S12). Compressor 14 performs signal processing of compressing the amplitude of the reference signal to suppress clipping of the reference signal (i.e., the peak portion of the reference signal is clipped and the waveform is changed) when the amplitude of the reference signal is greater than assumed. FIG. 4 illustrates signal processing performed by compressor 14.

Figure 5:
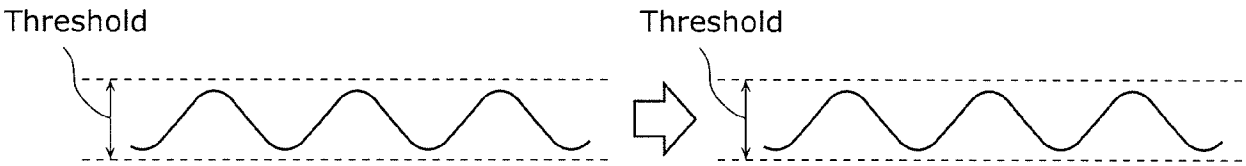
FIG. 5 illustrates signal processing performed by the compressor when the amplitude of the reference signal is less than the threshold.

As illustrated in FIG. 4, compressor 14 compresses the amplitude of a reference signal input to reference signal input terminal 11 and having an amplitude greater than or equal to a threshold, and outputs the compressed reference signal. In other words, compressor 14 reduces the amplitude of a reference signal having an amplitude greater than or equal to a threshold to an amplitude corresponding to approximately the threshold, and outputs the resulting reference signal. The waveform of the reference signal remains substantially the same as the waveform of the reference signal that is not yet compressed. Moreover, as illustrated in FIG. 5, compressor 14 outputs, as it is, the reference signal input to reference signal input terminal 11 and having an amplitude less than the threshold.

Next, adaptive filter unit 15 generates a canceling signal by applying an adaptive filter to the reference signal output from compressor 14 (multiplying the reference signal output from compressor 14 using an adaptive filter) (S13). Adaptive filter unit 15 is implemented as a so-called finite impulse response (FIR) filter or infinite impulse response (IIR) filter. Adaptive filter unit 15 outputs the generated canceling signal to canceling signal output terminal 12. The canceling signal is used to emit canceling sound N1 for reducing noise N0, and is output to canceling signal output terminal 12 (S14).

Canceling signal output terminal 12 is an exemplary canceling signal output unit, and is a terminal made of metal, etc. Canceling signal output terminal 12 receives the canceling signal generated by adaptive filter unit 15.

Canceling signal output terminal 12 is connected to canceling sound source 52. Thus, canceling sound source 52 receives the canceling signal via canceling signal output terminal 12. Canceling sound source 52 emits canceling sound N1 based on the canceling signal.

Error signal source 53 detects a residual sound resulting from interference between noise N0 and canceling sound N1 emitted from canceling sound source 52 corresponding to the canceling signal, and outputs an error signal corresponding to the residual sound. Consequently, the error signal is input to error signal input terminal 13 (S15). Error signal input terminal 13 is an exemplary error signal input unit, and is a terminal made of metal, etc.

Next, simulated acoustic transfer characteristic filter unit 16 generates a filtered reference signal by correcting the reference signal using simulated transfer characteristics which simulate acoustic transfer characteristics from canceling signal output terminal 12 to error signal input terminal 13 (S16). In other words, simulated transfer characteristics simulate acoustic transfer characteristics from the position of canceling sound source 52 to the position of error signal source 53. Simulated transfer characteristics are measured in space 55 in advance, and are stored on storage 18, for example. Note that simulated transfer characteristics may be defined by an algorithm which uses no predetermined value.

Storage 18 is a storage device that stores simulated transfer characteristics. Storage 18 also stores, for example, a coefficient of the adaptive filter, which will be described below. Specifically, storage 18 is implemented as a semiconductor memory, etc. Note that, when compressor 14, adaptive filter unit 15, simulated acoustic transfer characteristic filter unit 16, and filter coefficient updater 17 each are implemented as a processor such as a DSP, storage 18 also stores a control program executed by the processor. Storage 18 may also store other parameters to be used for signal processing performed by compressor 14, adaptive filter unit 15, simulated acoustic transfer characteristic filter unit 16, and filter coefficient updater 17.

Filter coefficient updater 17 successively updates coefficient W of the adaptive filter based on the error signal and the generated filtered reference signal (S17).

Specifically, filter coefficient updater 17 uses the least mean square (LMS) method to calculate coefficient W of the adaptive filter in such a manner that the sum of squares of the error signal is minimized, and outputs the calculated coefficient of the adaptive filter to adaptive filter unit 15. Furthermore, filter coefficient updater 17 successively updates the coefficient of the adaptive filter. Coefficient W of the adaptive filter is expressed as the following (Expression 1), where "e" denotes the vector of the error signal, "R" denotes the vector of the filtered reference signal. Note that n is a natural number and represents the n-th sample in sampling period Ts. Here, μ is a scalar quantity and is a step size parameter that determines an amount of updating coefficient W of the adaptive filter per sampling.

[Math. 1]

$$W(n+1)=W(n)-\mu\cdot e(n)\cdot R(n) \quad \text{(Expression 1)}$$

Note that filter coefficient updater 17 may update coefficient W of the adaptive filter using a method other than the LMS method.

As described above, active noise control device 10 includes compressor 14. Compressor 14 makes it possible to output a reference signal whose waveform is maintained to adaptive filter unit 15 and simulated acoustic transfer characteristic filter unit 16, even when the amplitude of the reference signal is greater than assumed due to noise N0, etc. that has occurred unexpectedly. In other words, even when the amplitude of the reference signal is extremely large, a signal having substantially the same frequency components as those of the reference signal is output to adaptive filter unit 15 and simulated acoustic transfer characteristic filter unit 16. Therefore, because an appropriate canceling signal is output from adaptive filter unit 15, this prevents the canceling sound from being perceived as an abnormal sound.

Operation for Stopping Updating Coefficient of Adaptive Filter

In active noise control device 10, when the amplitude of the reference signal is larger than assumed, the waveform of the reference signal may be clipped (i.e., the waveform of the reference signal may be changed). Consequently, noise cannot be reduced appropriately and the canceling sound may be perceived as an abnormal sound. When compressor 14 is compressing the reference signal (when the reference signal has an amplitude greater than or equal to the threshold), even though noise N0 is large, the reference signal is compressed to have a smaller amplitude and is output to adaptive filter unit 15 and simulated acoustic transfer characteristic filter unit 16. Thus, the coefficient of the adaptive filter becomes large and the gain increases (i.e., the effectiveness of the adaptive filter becomes strong). If the compression ratio of compressor 14 decreases while the coefficient of the adaptive filter is large, even though noise N0 is small, the effectiveness of the adaptive filter remains strong, and thus large canceling sound N1 will be emitted and it may be perceived as an abnormal sound.

Figure 6:
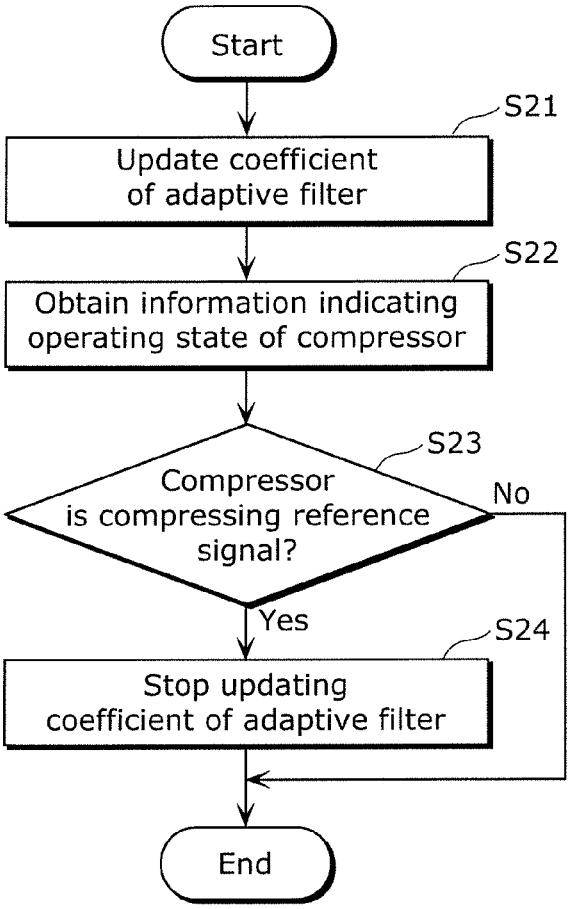
FIG. 6 is a flow chart of an operation for stopping updating of a coefficient of an adaptive filter when a compressed reference signal is being output from the compressor.

The amplitude of the reference signal being greater than or equal to the threshold is often caused when large noise N0 is unexpectedly generated, and it is considered that such a state does not usually continue for a long time. Thus, filter coefficient updater 17 may stop updating the coefficient of the adaptive filter, when a compressed reference signal is being output from compressor 14. FIG. 6 is a flow chart of such an operation for stopping updating the coefficient of the adaptive filter.

First, when filter coefficient updater 17 updates the coefficient of the adaptive filter (S21), information indicating the operating state of compressor 14 is obtained from compressor 14 (S22). The course of obtaining this information is illustrated with the dashed line arrow in FIG. 2. Next, filter coefficient updater 17 determines, based on the obtained information, whether compressor 14 is compressing the reference signal (S23). Note that filter coefficient updater 17 may monitor the amplitude of the reference signal input to reference signal input terminal 11, and perform a similar determination as in Step S23 by comparing the amplitude with the threshold.

When filter coefficient updater 17 determines that compressor 14 is compressing the reference signal (Yes in S23), filter coefficient updater 17 stops updating the coefficient of the adaptive filter (524). Specifically, filter coefficient updater 17 sets step size parameter μ=0 in (Expression 1) above, and outputs the same coefficient of the adaptive filter to adaptive filter unit 15. Stopping updating the coefficient of the adaptive filter can also be achieved by setting W(n+1)=W(n) and not rewriting W. When filter coefficient updater 17 determines that compressor 14 is not compressing the reference signal (No in S23), filter coefficient updater 17 continues to update the coefficient of the adaptive filter.

As described above, filter coefficient updater 17 stops updating the coefficient of the adaptive filter when a compressed reference signal is being output from compressor 14. This prevents large canceling sound N1 from being emitted and being perceived as an abnormal sound, when the amplitude of the reference signal is returned to an amplitude less than the threshold.

Embodiment 2

Configuration of Active Noise Control Device According to Embodiment 2

Figure 7:
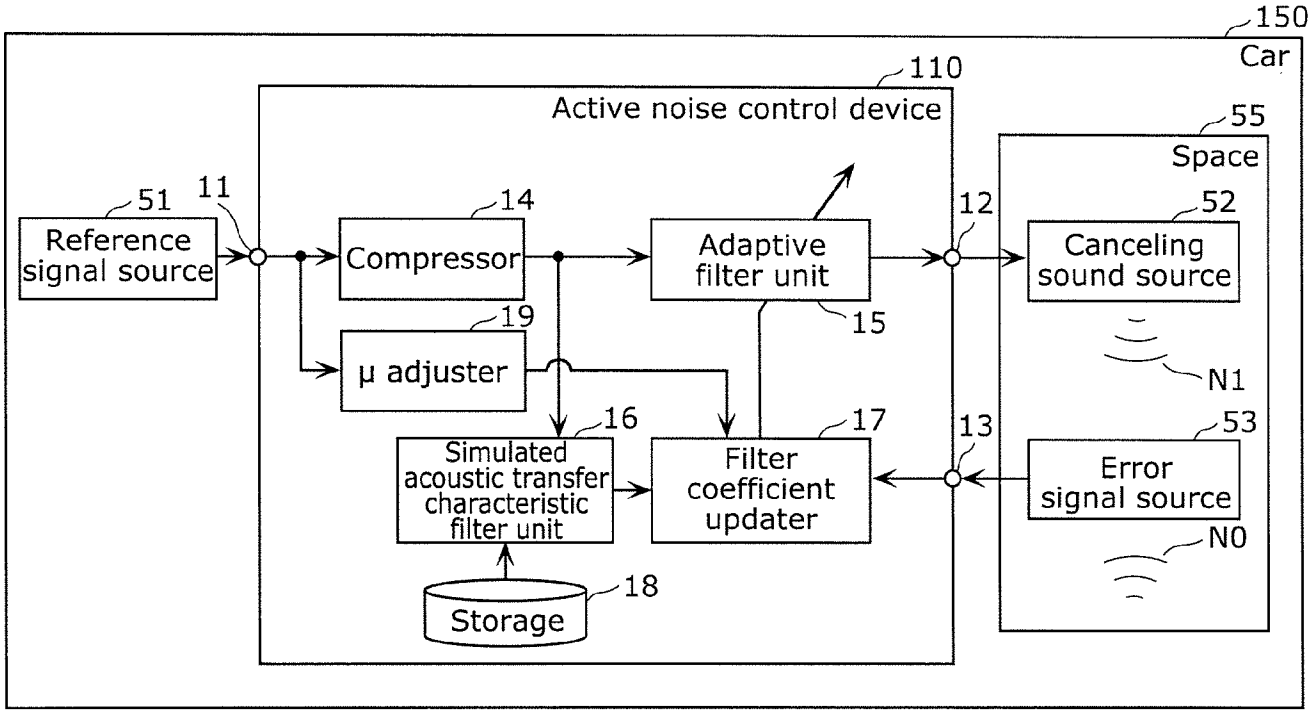
FIG. 7 is a block diagram illustrating a functional configuration of an active noise control device according to Embodiment 2.

The following describes a functional configuration of an active noise control device according to Embodiment 2. FIG. 7 is a block diagram illustrating the functional configuration of the active noise control device according to Embodiment 2. Note that, in following Embodiment 2, detailed description of the matters that have been already described will be omitted.

As illustrated in FIG. 7, car 150 is different from car 50 in that car 150 includes active noise control device 110 instead of active noise control device 10. Active noise control device 110 is different from active noise control device 10 in that active noise control device 110 includes μ adjuster 19.

Here, μ adjuster 19 adjusts step size parameter μ in (Expression 1) above, and causes filter coefficient updater 17 to use step size parameter μ that has been adjusted. In other words, μ adjuster 19 instructs the value of step size parameter μ to the filter coefficient updater.

When the value of step size parameter μ is too large, the adaptive filter is more likely to diverge. When the value is too small, the coefficient of the adaptive filter of filter coefficient updater 17 is not be updated in time, and a noise reduction effect decreases. Accordingly, for example, μ controller 19 sets step size parameter μ to a smaller value as the amplitude of the reference signal becomes larger. Specifically, μ controller 19 sets step size parameter μ to a value proportional to the reciprocal of the average value of the amplitude of the reference signal in the latest predetermined period. At this time, step size parameter μ is not zero.

In such a case, when step size parameter μ is adjusted using the reference signal output from compressor 14, the reference signal output from compressor 14 is compressed in some cases. In such cases, the value of step size parameter μ may not be adjusted appropriately.

In view of the above, in active noise control device 110, μ adjuster 19 adjusts step size parameter μ using the reference signal that is not yet input to compressor 14 (i.e., reference signal which is input to reference signal input terminal 11).

Such active noise control device 110 includes compressor 14, and can also adjust step size parameter μ appropriately when the compressed reference signal is output from compressor 14. Therefore, active noise control device 110 can improve the noise reduction effect when the compressed reference signal is output from compressor 14.

Variation of Embodiment 2

Figure 8:
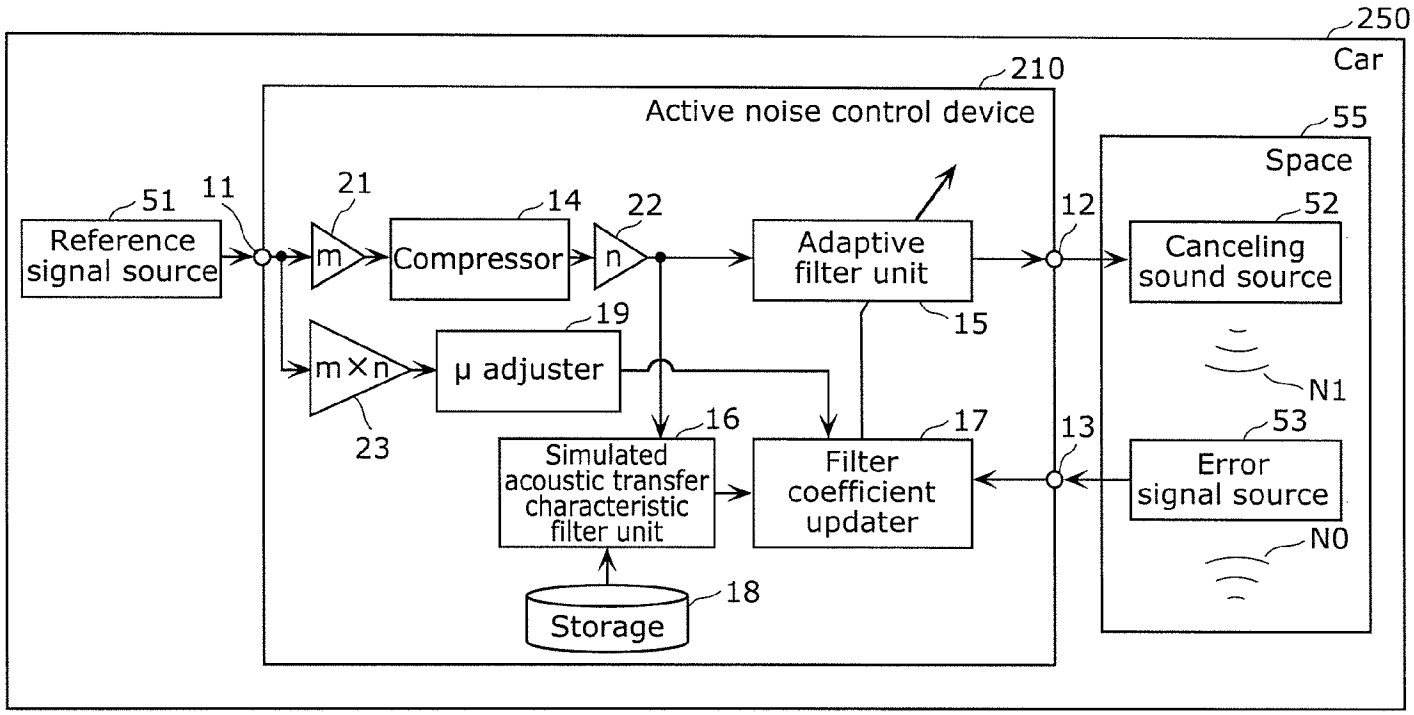
FIG. 8 is a block diagram illustrating a functional configuration of an active noise control device according to a variation of Embodiment 2.

Compressor 14 is implemented by performing software (control program) by a processor, such as a DSP, for example. When a user actually drives car 150 and sets a relationship between a threshold of compressor 14 and the amplitude of the reference signal, changing the design to amplify (or attenuate) the reference signal in a preceding stage and a following stage of compressor 14 may be easier than changing the threshold itself. Specifically, it is a case where a user wishes to implement compressor 14 by using existing software without any change. Accordingly, a gain adjuster may be placed in a preceding stage and a following stage of compressor 14. FIG. 8 is a block diagram illustrating a functional configuration of an active noise control device according to a variation of Embodiment 2.

As illustrated in FIG. 8, car 250 is different from car 150 in that car 250 includes active noise control device 210 instead of active noise control device 110. Active noise control device 210 is different from active noise control device 110 in that active noise control device 210 includes first gain adjuster 21, second gain adjuster 22, and third gain adjuster 23.

First gain adjuster 21 multiplies the reference signal input to reference signal input terminal 11 by m, and outputs the multiplied reference signal to compressor 14. Here, m is a positive number, and may be greater than or equal to 1, or less than 1. For example, first gain adjuster 21 may be implemented as hardware, such as an amplifier circuit, or may be implemented as software.

Second gain adjuster 22 multiplies the reference signal output from compressor 14 by n (n is a positive number), and outputs the multiplied reference signal to adaptive filter unit 15. Here, n is a positive number, and may be greater than or equal to 1, or less than 1. For example, second gain adjuster 22 may be implemented as hardware, such as an amplifier circuit, or may be implemented as software.

With such first gain adjuster 21 and second gain adjuster 22, the user can easily set the relationship between the threshold of compressor 14 and the amplitude of the reference signal.

With first gain adjuster 21 and second gain adjuster 22, the reference signal is multiplied by m×n and output to adaptive filter unit 15. At this time, active noise control device 210 includes third gain adjuster 23 so that μ adjuster 19 can appropriately adjust step size parameter μ.

Third gain adjuster 23 multiplies the reference signal that is not yet input to first gain adjuster 21 by m×n, and outputs the multiplied reference signal. For example, third gain adjuster 23 may be implemented as hardware, such as an amplifier circuit, or may be implemented as software. Here, μ adjuster 19 adjusts step size parameter μ using the reference signal output from third gain adjuster 23. Accordingly, μ adjuster 19 can appropriately adjust step size parameter μ.

Effects, Etc.

As described above, active noise control device 10 is an active noise control device that reduces noise N0 in space 55 in car 50. Active noise control device 10 includes: reference signal input terminal 11 that receives a reference signal output by reference signal source 51 mounted on car 50, the reference signal having a correlation with noise N0; compressor 14 that compresses the reference signal input to reference signal input terminal 11 and having an amplitude greater than or equal to a threshold, and outputs the reference signal compressed; adaptive filter unit 15 configured to generate a canceling signal to be used to output canceling sound N1 for reducing noise N0 by applying an adaptive filter to the reference signal output from compressor 14; and filter coefficient updater 17 that updates a coefficient of the adaptive filter. Car 50 is an example of a vehicle and reference signal input terminal 11 is an exemplary reference signal input unit.

Because such active noise control device 10 includes compressor 14, a reference signal whose waveform is maintained is output to adaptive filter unit 15, even when the amplitude of the reference signal is greater than assumed due to noise N0, etc. that has occurred unexpectedly. In other words, a signal having substantially the same frequency components as those of the reference signal is output to adaptive filter unit 15, even when the amplitude of the reference signal is extremely large. Therefore, active noise control device 10 can output a suitable canceling signal from adaptive filter unit 15. Consequently, this prevents the canceling sound from being perceived as an abnormal sound.

Moreover, filter coefficient updater 17 stops updating the coefficient of the adaptive filter, when a compressed reference signal is being output from compressor 14.

Such active noise control device 10 can prevent large canceling N1 from being output and being perceived as an abnormal sound, when the reference signal is returned to an amplitude less than the threshold.

Moreover, in active noise control device 110, filter coefficient updater 17 updates the coefficient of the adaptive filter using step size parameter μ. Active noise control device 110 further includes μ adjuster 19 that adjusts step size parameter μ using a reference signal that is not yet input to compressor 14.

Such active noise control device 110 includes compressor 14, and can also adjust step size parameter μ appropriately even when the compressed reference signal is being output from compressor 14. Thus, active noise control device 110 can improve the noise reduction effect when the compressed reference signal is being output from compressor 14.

Furthermore, active noise control device 210 further includes: first gain adjuster 21 that multiplies the reference signal received by reference signal input terminal 11 by m, where m is a positive number, and outputs the reference signal multiplied to compressor 14; second gain adjuster 22 that multiplies the reference signal output from compressor 14 by n, where n is a positive number, and outputs, to adaptive filter unit 15, the reference signal multiplied; and a third gain adjuster that multiplies the reference signal that is not yet input to first gain adjuster 21 by m×n, and outputs, to μ adjuster 19, the reference signal multiplied. The μ adjuster 19 adjusts step size parameter μ using the reference signal output from third gain adjuster 23.

Such active noise control device 210 enables a user to easily set a relationship between the threshold of compressor 14 and the amplitude of the reference signal using first gain adjuster 21 and second gain adjuster 22. Furthermore, active noise control device 210 can appropriately adjust step size parameter μ.

Furthermore, each of active noise control devices 10, 110, and 210 further includes: canceling signal output terminal 12 that receives the canceling signal generated; error signal input terminal 13 that receives an error signal corresponding to a residual sound resulting from interference between canceling sound N1 and noise N0; and simulated acoustic transfer characteristic filter unit 16 that generates a filtered reference signal obtained by correcting the reference signal using simulated transfer characteristics that simulate acoustic transfer characteristics from canceling signal output terminal 12 to error signal input terminal 13. Filter coefficient updater 17 updates the coefficient of the adaptive filter using the error signal and the filtered reference signal. Canceling signal output terminal 12 is an exemplary canceling signal output unit, and error signal input terminal 13 is an exemplary error signal input unit.

Such active noise control devices 10, 110, and 210 can update the coefficient of the adaptive filter using the error signal and the filtered reference signal.

Furthermore, the active noise control method performed by a computer, such as active noise control device 10, is an active noise control method that reduces the noise in space 55 in car 50. Such an active noise control method includes: a first step of compressing a reference signal that is output from reference signal source 51 mounted on car 50, has a correlation with noise N0, and has an amplitude greater than or equal to a threshold, and outputting a compressed signal of the reference signal; a second step of generating a canceling signal that is used to emit canceling sound N1 for reducing noise N0 by applying an adaptive filter to the reference signal output in the first step; and a third step of updating the coefficient of the adaptive filter.

Similar to active noise control device 10, such an active noise control method can prevent the canceling sound from being perceived as an abnormal sound.

Other Embodiments

Hereinbefore, Embodiments 1 and 2 have been described, but the present disclosure is not limited to Embodiments 1 and 2 described above.

The active noise control device according to the above embodiments may be provided in a vehicle other than a car. The vehicle may be an aircraft or a ship, for example. The present disclosure may be achieved as a vehicle other than such a car.

Furthermore, the configuration of the active noise control device according to each of Embodiments 1 and 2 is an example. For example, the active noise control device may also include a structural component, such as a D/A converter, a filter, a power amplifier, or an A/D converter.

Furthermore, the processes performed by the active noise control device according to each of Embodiments 1 and 2 are examples. For example, a part of the processes described in the foregoing embodiment may be realized by analog signal processing instead of digital signal processing.

Furthermore, for example, in Embodiments 1 and 2, a process performed by a certain processing unit may be performed by a different processing unit. Furthermore, the order of a plurality of processes may be changed or the processes may be performed in parallel.

Furthermore, in Embodiments 1 and 2, each structural component may be realized by executing a software program suitable for each structural component. Each structural component may be realized by reading out and executing a software program recorded on a recording medium, such as a hard disk or a semiconductor memory, by a program executer, such as a CPU or a processor.

Furthermore, in Embodiments 1 and 2, each structural component may be realized by hardware. For example, each structural component may be a circuit (or an integrated circuit). The circuits may constitute a single circuit as a whole, or may be individual circuits. Furthermore, each of the circuits may be a general-purpose circuit, or may be a dedicated circuit.

Furthermore, each structural component may be a circuit (or an integrated circuit). The circuits may constitute a single circuit as a whole, or may be individual circuits. Furthermore, each of the circuits may be a general-purpose circuit, or may be a dedicated circuit.

Furthermore, an overall or specific aspect of the present disclosure may be implemented using a system, a device, a method, an integrated circuit, a computer program, or a computer-readable non-transitory recording medium such as a CD-ROM. Furthermore, an overall or specific aspect of the present disclosure may also be implemented by combining a system, a device, a method, an integrated circuit, a computer program, or a computer-readable non-transitory recording medium in any manner.

For example, the present disclosure may also be implemented as an active noise control method executed by the active noise control device (a computer or a DSP), or may also be implemented as a program for causing a computer or a DSP to execute the active noise control method. Furthermore, the present disclosure may be implemented as a vehicle (for example, a car) or a noise reduction system including the active noise control device according to the foregoing embodiments and a reference signal source.

The present disclosure includes, for example, embodiments that can be obtained by various modifications to the respective embodiments and variations that may be conceived by those skilled in the art, and embodiments obtained by combining structural components and functions in the respective embodiments in any manner without departing from the essence of the present disclosure.

INDUSTRIAL APPLICABILITY

The active noise control device according to the present disclosure is useful as an active noise control device capable of reducing noise in a passenger compartment, for example.

While various embodiments have been described herein above, it is to be appreciated that various changes in form and detail may be made without departing from the spirit and scope of the invention(s) presently or hereafter claimed.

Further Information about Technical Background to this Application

The disclosure of the following Japanese Patent Application including specification, drawings and claims is incorporated herein by reference in its entirety: Japanese Patent Application No. 2018-194137 filed Oct. 15, 2018.

The invention claimed is:

1. An active noise control device, comprising:

a reference signal source that outputs a reference signal having a correlation with noise;

a reference signal input configured to receive the reference signal output from the reference signal source;

a first gain adjuster that multiplies the reference signal received by the reference signal input by m, where m is a positive number, and outputs, to a compressor, the reference signal multiplied by m;

the compressor that compresses an amplitude of the reference signal multiplied by m within a threshold so that clipping of the reference signal multiplied by m is suppressed and outputs a compressed signal of the reference signal multiplied by m when the amplitude of the reference signal multiplied by m is greater than or equal to the threshold;

a second gain adjuster that multiplies the compressed signal output from the compressor by n, where n is a positive number, and outputs, to an adaptive filter, the compressed signal multiplied by n;

the adaptive filter configured to generate a canceling signal having a phase opposite to a phase of the compressed signal multiplied by n, the compressed signal multiplied by n being multiplied using the adaptive filter, the adaptive filter having a coefficient that is updated successively;

a filter coefficient updater that updates the coefficient of the adaptive filter using a step size parameter, the step size parameter determining an amount of updating the coefficient of the adaptive filter based on a change in the amplitude of the reference signal;

a third gain adjuster that multiplies the reference signal that is not yet input to the first gain adjuster by m×n, and outputs, to a μ adjuster, the reference signal multiplied by m×n; and the μ adjuster that adjusts the step size parameter using the reference signal multiplied by m×n and output from the third gain adjuster.

2. The active noise control device according to claim 1, wherein updating the coefficient of the adaptive filter is stopped while the compressor outputs the compressed signal.

3. The active noise control device according to claim 1, further comprising:

a canceling signal output configured to receive the canceling signal;

an error signal input configured to receive an error signal that corresponds to a residual sound resulting from interference between the noise and a canceling sound for reducing the noise, the canceling sound being generated using the canceling signal output from the canceling signal output; and a simulated acoustic transfer characteristic filter configured to generate a filtered reference signal obtained by correcting the reference signal using simulated transfer characteristics that simulate acoustic transfer characteristics from the canceling signal output to the error signal input, wherein the coefficient of the adaptive filter is further updated using the error signal and the filtered reference signal.

4. A vehicle, comprising:

the active noise control device according to claim 1.

5. The active noise control device according to claim 1, wherein a waveform of the compressed signal is same as a waveform of the reference signal.

6. The active noise control device according to claim 1, wherein the compressed signal and the reference signal have a same frequency.

7. The active noise control device according to claim 1, wherein the compressed signal and the reference signal have a same wavelength.

8. An active noise control method, comprising:

multiplying a reference signal by m, where m is a positive number, the reference signal being output from a reference signal source and having a correlation with noise;

compressing an amplitude of the reference signal multiplied by m within a threshold so that clipping of the reference signal multiplied by m is suppressed, the reference signal multiplied by m having the amplitude greater than or equal to the threshold;

outputting a compressed signal of the reference signal multiplied by m;

multiplying the compressed signal by n, where n is a positive number;

generating a canceling signal having a phase opposite to a phase of the compressed signal multiplied by n by multiplying the compressed signal multiplied by n output in the multiplying using an adaptive filter, the adaptive filter having a coefficient that is updated successively;

updating the coefficient of the adaptive filter using a step size parameter, the step size parameter determining an amount of updating the coefficient of the adaptive filter based on a change in the amplitude of the reference signal;

multiplying the reference signal, that is not yet multiplied by m, by m×n, and adjusting the step size parameter using the reference signal multiplied by m×n.

9. The active noise control method according to claim 8, wherein a waveform of the compressed signal is same as a waveform of the reference signal.

10. The active noise control method according to claim 8, wherein the compressed signal and the reference signal have a same frequency.

11. The active noise control method according to claim 8, wherein the compressed signal and the reference signal have a same wavelength.

12. An active noise control device, comprising:

a processor; and a memory including a control program that, when executed by the processor, causes the processor to perform operations, the operations including:

receiving a reference signal output from a reference signal source, the reference signal having a correlation with noise;

multiplying the reference signal by m, where m is a positive number, the reference signal multiplied by m having an amplitude greater than or equal to a threshold;

compressing the amplitude of the reference signal multiplied by m within the threshold so that clipping of the reference signal multiplied by m is suppressed;

outputting a compressed signal of the reference signal multiplied by m;

multiplying the compressed signal by n, where n is a positive number;

generating a canceling signal having a phase opposite to a phase of the compressed signal by multiplying the compressed signal multiplied by n using an adaptive filter, the adaptive filter having a coefficient that is updated successively;

updating the coefficient of the adaptive filter using a step size parameter, the step size parameter determining an amount of updating the coefficient of the adaptive filter based on a change in the amplitude of the reference signal;

multiplying the reference signal, that is not yet multiplied by m, by m×n; and adjusting the step size parameter using the reference signal multiplied by m×n.

13. The active noise control device according to claim 12, the operations further including:

stopping the updating of the coefficient of the adaptive filter while the compressed signal is output.

14. The active noise control device according to claim 12, the operations further including:

receiving an error signal that corresponds to a residual sound resulting from interference between the noise and a canceling sound for reducing the noise, the canceling sound being generated using the canceling signal; and generating a filtered reference signal obtained by correcting the reference signal using simulated transfer characteristics that simulate acoustic transfer characteristics from the canceling signal, wherein the coefficient of the adaptive filter is further updated using the error signal and the filtered reference signal.

15. The active noise control device according to claim 12, wherein a waveform of the compressed signal is same as a waveform of the reference signal.

16. The active noise control device according to claim 12, wherein the compressed signal and the reference signal have a same frequency.

17. The active noise control device according to claim 12, wherein the compressed signal and the reference signal have a same wavelength.

* * * * *